US008284014B2

(12) United States Patent
Jha

(10) Patent No.: US 8,284,014 B2
(45) **Date of Patent: *Oct. 9, 2012**

(54) DIGITAL POTENTIOMETER WITH INDEPENDENT CONTROL OVER BOTH RESISTIVE ARMS

(75) Inventor: Kaushal Kumar Jha, Bangalore (IN)

(73) Assignee: Analog Devices, Inc., Norwood, MA (US)

( * ) Notice: Subject to any disclaimer, the term of this patent is extended or adjusted under 35 U.S.C. 154(b) by 86 days.

This patent is subject to a terminal disclaimer.

(21) Appl. No.: 12/861,103

(22) Filed: Aug. 23, 2010

(65) Prior Publication Data

US 2012/0044040 A1 Feb. 23, 2012

(51) Int. Cl.
*H01C 10/30* (2006.01)

(52) U.S. Cl. ..... 338/118; 338/185; 341/154; 341/145

(58) Field of Classification Search ..... 338/118, 338/185, 190, 200, 334; 341/144, 145, 153, 341/154

See application file for complete search history.

(56) References Cited

U.S. PATENT DOCUMENTS

| | | | | |
|---|---|---|---|---|
| 4,016,483 | A * | 4/1977 | Rudin | 323/354 |
| 5,717,935 | A | 2/1998 | Zanders et al. | |
| 6,201,491 | B1 * | 3/2001 | Brunolli et al. | 341/144 |
| 6,414,616 | B1 * | 7/2002 | Dempsey | 341/144 |
| 6,885,328 | B1 * | 4/2005 | Kao et al. | 341/144 |
| 7,535,395 | B2 | 5/2009 | Voicu et al. | |
| 2002/0135458 | A1 * | 9/2002 | Drori et al. | 338/190 |
| 2005/0270043 | A1 | 12/2005 | Jacob et al. | |
| 2010/0201476 | A1 | 8/2010 | Jha et al. | |

OTHER PUBLICATIONS

PCT International Search Report and Written Opinion for PCT/US11/047177 mailed on Dec. 12, 2011.

* cited by examiner

*Primary Examiner* — Kyung Lee
(74) *Attorney, Agent, or Firm* — Kenyon & Kenyon LLP

(57) ABSTRACT

A digital potentiometer includes a circuit containing multiple string arrays, each having a plurality of switching devices connected to an array of resistors. Each input terminal receives a separate digital input code enabling the resistance of one of the arms to be varied without changing the other.

23 Claims, 1 Drawing Sheet

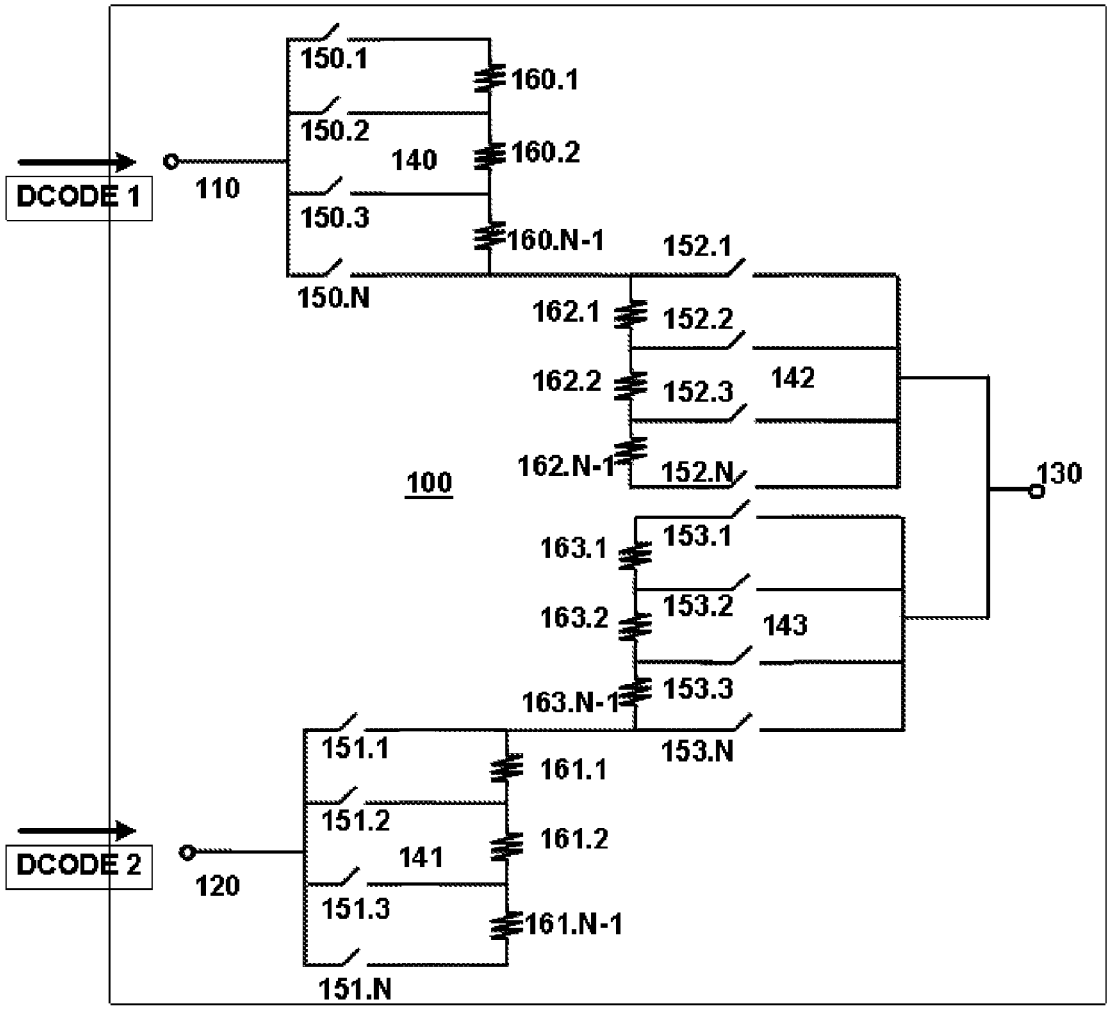
DCODE 1
110
150.1
150.2
150.3
150.N
140
160.1
160.2
160.N-1
152.1
152.2
152.3
152.N
162.1
162.2
162.N-1
142
100
130
153.1
153.2
153.3
153.N
163.1
163.2
163.N-1
143
DCODE 2
120
151.1
151.2
151.3
151.N
141
161.1
161.2
161.N-1

DIGITAL POTENTIOMETER WITH INDEPENDENT CONTROL OVER BOTH RESISTIVE ARMS

FIELD OF THE INVENTION

The present invention relates to the architecture of a digital potentiometer which allows for an independent control of the resistance of the potentiometer arms in the potentiometer. The present invention further relates to the input of multiple digital codes to a digital potentiometer to change the resistances of each of the potentiometer arms in the potentiometer.

BACKGROUND INFORMATION

The following application is hereby incorporated by reference herein: U.S. patent application Ser. No. 12/367,243 ("the '243 application"), filed Feb. 6, 2009.

Potentiometers are electric devices used in a variety of electrical circuits, including those where a specific voltage output is needed. Potentiometers allow for a user to create a constant resistance between the terminals, whereupon the user can change the resistance between the terminals by mechanically adjusting the potentiometer. In a digital potentiometer, a digital input code is input to the potentiometer which accepts the input code and adjusts the resistance of the potentiometer accordingly.

A digital potentiometer has three terminals: two primary terminals and a third terminal referred to as the wiper. The resistance between the primary terminals is constant and is equal to a total end-to-end resistance of the entire potentiometer. The resistance between the first primary terminal, A, and the wiper is equal to:

$$\frac{D * R_{TOTAL}}{2^n}, \quad \text{(i)}$$

wherein D is a decimal equivalent of an n-bit input code, $R_{TOTAL}$ is a total end-to-end resistance of the entire potentiometer, and n is the number of bits of the input code to the potentiometer.

Conversely, the resistance between the second primary terminal, B, and the wiper is equal to:

$$\frac{R_{TOTAL} * (2^n - D)}{2^n}, \quad \text{(ii)}$$

wherein the total resistance between terminals A and B is the total end-to-end resistance of the potentiometer and is equal to:

$$\frac{D * R_{TOTAL}}{2^n} + \frac{R_{TOTAL} * (2^n - D)}{2^n}. \quad \text{(iii)}$$

The problem with traditional digital potentiometers is that the resistance between terminal A and the wiper (one of the resistance "arms") is dependant on the resistance between terminal B and the wiper (the other resistance "arm"). In typical architectures for the digital potentiometer, the primary terminals share a final string array at the wiper. Therefore, any adjustment of the resistance between one of the terminals and the wiper changes the resistance between the other terminal and the wiper, because of the presence of the single shared string array. This problem is further evidenced by equations (i) and (ii) in which a change to the input code D, changes the resistance for each of the resistance arms. In traditional digital potentiometers, a single digital input is provided to each of the primary terminals, and therefore the resistance of the resistance arms is dependent on the single digital input.

The current structure of a traditional digital potentiometer only allows for a selection of the terminal A-to-wiper resistance that is dependent and based on set ratios to the terminal B-to-wiper resistance, because of the presence of a shared string array between each of the terminals and the wiper terminal. Therefore, there remains a need in the art, for a digital potentiometer architecture which allows for the independent control of the resistance between each of the primary terminals and the wiper.

SUMMARY OF THE INVENTION

To address the above limitations of digital potentiometers, the present invention provides a model for the architecture of a digital potentiometer which allows for an independent control of the resistances between the primary terminals and the wiper terminal. This is achieved by initially inserting an additional string array between the primary terminals and the wiper terminal so that the primary terminals do not share a common string array at the wiper terminal, as discussed in the '243 application, and by creating an architecture which accepts two separate and distinct n-bit codes. In such an architecture, one of the primary terminals receives a first digital input code, and the second primary terminal receives a second digital input code.

The architecture contains an integrated circuit, with three separate terminals: primary terminals A, B, and the wiper terminal, W. Terminals A and B represent two pins of the potentiometer, which can contact to a plurality of electrical devices and voltage inputs. The resistance between terminals A and B represents the entire resistance range of the digital potentiometer.

Terminals A and B are connected to the W terminal by a series of one or more string arrays, with the total number of string arrays equal to $2^n$, where n equals the number of bits on the input codes. Each string includes a plurality of digital switches that are connected in parallel to one another. The digital switches may be MOSFET devices. The plurality of switches in the string arrays are connected at terminals A and B, and the output terminals of the switches are connected to an array of resistors.

A first digital code, CODE1, is input to terminal A. A resistance between terminal A and the wiper is further determined based on the input code. Conversely, the resistance between terminal B and the wiper is independent of CODE1, as it is not affected by the application of CODE1 to terminal A. A second input code, CODE2, is input to the digital potentiometer and is applied to terminal B. The resistance between terminal B and the wiper is determined directly from the applied CODE2.

Further details and aspects of example embodiments of the present invention are described in more detail below with reference to the appended FIGURE.

BRIEF DESCRIPTION OF THE DRAWING

FIG. 1 is a circuit diagram of the digital potentiometer with multiple digital inputs according to the present invention.

DETAILED DESCRIPTION

The subject invention will now be described in detail for specific preferred embodiments of the invention, it being understood that these embodiments are intended only as illustrative examples and the invention is not to be limited thereto.

A dependence on the resistance between another resistance branch to modify the resistance between a terminal and the wiper may be overcome by applying separate digital input signals to each one of the primary terminals of the digital potentiometer. Embodiments of the present invention may provide a circuit which includes a plurality of string arrays each having a plurality of parallel field-effect transistors that may operate as switches. Resistive arrays that are connected in series may be coupled to the terminals of the plurality of switches as further exemplified in the example embodiments.

FIG. 1 illustrates a digital potentiometer 100 according to the present invention. Digital potentiometer 100 may include two primary terminals 110 and 120, and a wiper terminal 130. Terminals 110 and 120 may operate as pins of potentiometer 100 and may be electrically coupled to other electric circuit devices. Wiper terminal 130 may also be connected to other electrical devices, but may be connected to terminals 110 and 120 through string arrays 140-143. As depicted in FIG. 1, wiper terminal 130 may be connected to terminal 110 through string arrays 140 and 142. Terminal 120 may be connected to wiper terminal 130 through string arrays 141 and 143. Although FIG. 1 illustrates two string arrays connecting terminal 110 to wiper terminal 130, and two string arrays connecting terminal 120 to wiper terminal 130, it should be understood that the present invention may apply to any embodiment having any number of string arrays between each of the terminals and the wiper.

String arrays 140-143 may contain a plurality of parallel digital switches 150.1-150.N, 151.1-151.N, 152.1-152.N, 153.1-153.N, whose output terminals may be connected to an array of resistors that are connected in series. The plurality of digital switches may control the number of resistors that may be connected to wiper terminal 130 at any time. The closure of a switch may connect terminal 120 or 130 directly to a tap point on the resistor array 161.1-161.N−1 or 163.1-163.N−1, and the amount of resistance between one of the terminals and the wiper may change to the sum of the resistances between the tap point and the wiper. An appropriate selection of the digital switches may be MOSFET devices such as CMOS devices which have a large switching range. In string array 140, switches 150.1-150.N may be connected in parallel, where the input terminals of the switches may be coupled together at terminal 110. Given a number of digital bits which are input to a given string, such as M, the number of switches in the string may be equal to $2^M-1$.

The output terminals of switches 150.1-150.N may be connected to resistor array 160.1-160.N−1 at selected tap points. The resistors may be chosen at intervals that may allow for a selectable range of resistances and the number of resistors in resistor array 160.1-160.N−1 may be equal to n−1. Thus, the number of resistors in each of the resistor arrays may be one less than the total number of bits of an applied input code. The number of resistors in each resistor array may also be one less than the number of switches in each string array. Resistor 160.N−1 and switch 150.N may be coupled to switch 152.1 and resistor 162.1 in string array 142.

String array 142 may connect string 140 with wiper terminal 130. String array 142 may also contain a plurality of switches 152.1-152.N whose output may be tied to wiper terminal 130. The input terminals of switches 152.1-152.N may be connected to resistor array 162.1-162.N−1 at selected tap points.

String array 141 may contain a plurality of switches 151.1-151.N connected in parallel which may be tied to the input of the string at terminal 120. The outputs of switches 151.1-151.N may be connected to an array of resistors 161.1-161.N−1, at selected tap points. Switch 151.1 and resistor 161.1 may be directly coupled to resistor 163.N−1 and switch 153.N in switch array 143.

String array 143 may directly connect string array 141 to wiper terminal 130. Array 143 may resemble string array 142, as a plurality of parallel switches 153.1-153.N may be connected to an array of resistors 163.1-163.N−1, at the inputs of the switches. The outputs of switches 153.1-153.N may be coupled to wiper terminal 130. As depicted in FIG. 1, string array 143 may be electrically isolated from string array 142, except at wiper terminal 130, thereby creating independent connections between terminal 110 and wiper 130, and terminal 120 and wiper 130.

In alternative embodiments, additional strings may be inserted between string array 140 and 142, and between string array 141 and 143. Additionally, in alternate embodiments, string arrays may be inserted between terminal 110 and string array 140 or between terminal 120 and string array 141. Any additional inserted strings may have an orientation like arrays 140 and 141, where the outputs of the switches are connected to the resistor arrays, or like arrays 142 and 143, where the inputs of the switches are connected to the resistor arrays.

During operation, a first input code, CODE1 may be applied to the potentiometer at terminal 110. CODE1 may be any n-bit input digital signal code, with an example embodiment having an 8-bit digital code used. As discussed, the number of switches in each string array may be equal to the number of bits of the input code, with the number of resistors being one less than the number of bits. In an example embodiment using an 8-bit input code, there may be 8 switches and 7 resistors in each string array. For clarity, FIG. 1 illustrates a system using a 4-bit input code, resulting in 4 switches and 3 resistors in each string array.

The state of each of the switches 150.1-150.N and 152.1-152.N may depend on CODE1. Switches 150.1-150.N may be selectively turned on (closed) based on the input code, with only one of the switches being turned on at a time, in ascending order from switch 150.1 to 150.N. Table 1 depicts the state of the switches for a 4-bit input code for CODE1, wherein the input code may be represented by binary input [$B_3$ $B_2$ $B_1$ $B_0$], and $B_3$, $B_2$, $B_1$, and $B_0$, represent the bit positions of CODE1. In the lowest state [0 0 0 0], switch 150.1 may be turned on, while switch 152.4 in string array 142 may also be turned on. Switches 152.1-152.N may be turned on in descending order based on the value of the input. In the lowest state, switches 150.1 and 152.4 may connect terminal 110 to wiper terminal 130 through resistor arrays 160.1-160.N−1 and 162.1-162.N−1. This total resistance may represent $R_{MAX}$, which is the maximum resistance that may be achieved between terminal 110 and wiper terminal 130. Therefore, higher resistance may be achieved between terminal 110 and wiper terminal 130 with a low input code.

TABLE 1

| Input Code | | | | State of Switches | | | | | | | |
|---|---|---|---|---|---|---|---|---|---|---|---|
| 3 | 2 | 1 | 0 | 150.1 | 150.2 | 150.3 | 150.4 | 152.4 | 152.3 | 152.2 | 152.1 |
| 0 | 0 | 0 | 0 | ON | OFF | OFF | OFF | ON | OFF | OFF | OFF |
| 0 | 0 | 0 | 1 | ON | OFF | OFF | OFF | OFF | ON | OFF | OFF |

TABLE 1-continued

| Input Code | | | | State of Switches | | | | | | | |
|---|---|---|---|---|---|---|---|---|---|---|---|
| 3 | 2 | 1 | 0 | 150.1 | 150.2 | 150.3 | 150.4 | 152.4 | 152.3 | 152.2 | 152.1 |
| 0 | 0 | 1 | 0 | ON | OFF | OFF | OFF | OFF | OFF | ON | OFF |
| 0 | 0 | 1 | 1 | ON | OFF | OFF | OFF | OFF | OFF | OFF | ON |
| 0 | 1 | 0 | 0 | OFF | ON | OFF | OFF | ON | OFF | OFF | OFF |
| 0 | 1 | 0 | 1 | OFF | ON | OFF | OFF | OFF | ON | OFF | OFF |
| 0 | 1 | 1 | 0 | OFF | ON | OFF | OFF | OFF | OFF | ON | OFF |
| 0 | 1 | 1 | 1 | OFF | ON | OFF | OFF | OFF | OFF | OFF | ON |
| 1 | 0 | 0 | 0 | OFF | OFF | ON | OFF | ON | OFF | OFF | OFF |
| 1 | 0 | 0 | 1 | OFF | OFF | ON | OFF | OFF | ON | OFF | OFF |
| 1 | 0 | 1 | 0 | OFF | OFF | ON | OFF | OFF | OFF | ON | OFF |
| 1 | 0 | 1 | 1 | OFF | OFF | ON | OFF | OFF | OFF | OFF | ON |
| 1 | 1 | 0 | 0 | OFF | OFF | OFF | ON | ON | OFF | OFF | OFF |
| 1 | 1 | 0 | 1 | OFF | OFF | OFF | ON | OFF | ON | OFF | OFF |
| 1 | 1 | 1 | 0 | OFF | OFF | OFF | ON | OFF | OFF | ON | OFF |
| 1 | 1 | 1 | 1 | OFF | OFF | OFF | ON | OFF | OFF | OFF | ON |

In the next highest state [0 0 0 1], switch 150.1 may also be on, but switch 152.4 may be turned off. In this state, switch 152.3 may be turned on, connecting terminal 110 to the wiper. The total resistance between terminal 110 and wiper terminal 130 in this state may be the array of resistors 160.1-160.N−1 and resistors 162.1 and 162.2. Table 1 further depicts the states of the switches in all 16 possible states of a 4-bit input code. For all possible n-bit input codes, the number of possible states may be $2^n$. For an embodiment using 8-bit input codes, the total number of possible states may be 256.

In an example embodiment using a 4-bit input, as depicted in Table 1, the highest input may be the input [1 1 1 1]. In this state, switches 150.4 and 152.1 may be turned on. FIG. 1 illustrates that when switches 150.4 and 152.1 are both turned on, the arrays of resistors in strings 140 and 142 are bypassed and no resistance is connected between terminal 110 and wiper terminal 130. Therefore, a higher input to terminal 110 may correlate to a lower selected resistance between terminal 110 and the wiper. The total resistance between input terminal 110 and wiper terminal 130 may be inversely proportional to the value of the applied input signal.

A resistance between input terminal 110 and wiper terminal 130 may be modeled by the equation:

$$\frac{(2^n - \text{CODE1}) * R_{MAX}}{2^n}, \quad \text{(iv)}$$

wherein CODE1 is the digital input code applied to terminal 110, and $R_{MAX}$ is the maximum resistance that may be achieved.

Equation (iv) may be similar to equation (i) but may only depend on one of multiple input codes and not a single input code applied to both terminals 110 and 120 of the potentiometer. Since string arrays 140 and 141 are not connected to the wiper through a shared string array, switches 151.1-151.N and 153.1-153.N in string arrays 141 and 143 are not affected and do not turn on or off when CODE1 is applied to terminal 110. Additionally, equation (iv) may be dependent only on $R_{MAX}$, which is the sum of the array of resistors 160.1-160.N−1 and 162.1-162.N−1, and may be exactly half of $R_{TOTAL}$, if the resistor values in the arrays are uniform between the strings. The resistance between terminal 110 and wiper terminal 130 may also be modeled by the equation $$\frac{\text{CODE1} * R_{MAX}}{2^n},$$

depending on the relationship between the input code and the turned on switch.

A second input code, CODE2, may conversely be applied to terminal 120. CODE2 may also be an n-bit input digital signal code having the same number of bits as CODE1. The states of switches 151.1-151.N and 153.1-153.N may depend on CODE2. Switches 151.1-151.N may be selectively turned on relative to the value of the input code, in descending order from switches 151.N to 151.1. Table 2 may depict the state of the switches for a 4-bit input code for CODE2, wherein the input code may also be represented by binary input [$B_3$ $B_2$ $B_1$ $B_0$].

In a lowest state [0 0 0 0], switch 151.4 may be turned on, while switch 153.1 in string array 143 may also be turned on. Switches 153.1-153.N may be turned on in ascending order based on the value of input code CODE2. In the lowest state, the entire resistor arrays 161.1-161.N−1 and 163.1-163.N−1, $R_{MAX}$, may be connected between terminal 120 to wiper terminal 130. The maximum resistance between terminal 120 and wiper terminal 130 may be the same as the maximum resistance between terminal 110 and wiper terminal 130, as long as the array of resistors have the same resistive values between the strings. In accordance with the upper branch, a higher resistance may be achieved between terminal 120 and wiper terminal 130 with a low input code.

TABLE 2

| Input Code | | | | State of Switches | | | | | | | |
|---|---|---|---|---|---|---|---|---|---|---|---|
| 3 | 2 | 1 | 0 | 151.4 | 151.3 | 151.2 | 151.1 | 153.1 | 153.2 | 153.3 | 153.4 |
| 0 | 0 | 0 | 0 | ON | OFF | OFF | OFF | ON | OFF | OFF | OFF |
| 0 | 0 | 0 | 1 | ON | OFF | OFF | OFF | OFF | ON | OFF | OFF |
| 0 | 0 | 1 | 0 | ON | OFF | OFF | OFF | OFF | OFF | ON | OFF |
| 0 | 0 | 1 | 1 | ON | OFF | OFF | OFF | OFF | OFF | OFF | ON |
| 0 | 1 | 0 | 0 | OFF | ON | OFF | OFF | ON | OFF | OFF | OFF |
| 0 | 1 | 0 | 1 | OFF | ON | OFF | OFF | OFF | ON | OFF | OFF |

TABLE 2-continued

| Input Code | | | | State of Switches | | | | | | | |
|---|---|---|---|---|---|---|---|---|---|---|---|
| 3 | 2 | 1 | 0 | 151.4 | 151.3 | 151.2 | 151.1 | 153.1 | 153.2 | 153.3 | 153.4 |
| 0 | 1 | 1 | 0 | OFF | ON | OFF | OFF | OFF | OFF | ON | OFF |
| 0 | 1 | 1 | 1 | OFF | ON | OFF | OFF | OFF | OFF | OFF | ON |
| 1 | 0 | 0 | 0 | OFF | OFF | ON | OFF | ON | OFF | OFF | OFF |
| 1 | 0 | 0 | 1 | OFF | OFF | ON | OFF | OFF | ON | OFF | OFF |
| 1 | 0 | 1 | 0 | OFF | OFF | ON | OFF | OFF | OFF | ON | OFF |
| 1 | 0 | 1 | 1 | OFF | OFF | ON | OFF | OFF | OFF | OFF | ON |
| 1 | 1 | 0 | 0 | OFF | OFF | OFF | ON | ON | OFF | OFF | OFF |
| 1 | 1 | 0 | 1 | OFF | OFF | OFF | ON | OFF | ON | OFF | OFF |
| 1 | 1 | 1 | 0 | OFF | OFF | OFF | ON | OFF | OFF | ON | OFF |
| 1 | 1 | 1 | 1 | OFF | OFF | OFF | ON | OFF | OFF | OFF | ON |

In a subsequent state [0 0 0 1], switch 151.4 may also be on, but switch 153.1 may be turned off. In this state, switch 153.2 may be turned on, connecting terminal 120 to wiper terminal 130 through the array of resistors 161.1-161.N−1 and resistors 163.2 and 163.3. Table 2 further depicts the remaining states of the switches for the lower arm for the remaining states. The highest input state [1 1 1 1] may connect wiper terminal 130 to terminal 120 through switches 151.1 and 153.4 and bypassing any resistors. Therefore, in the lower branch, a higher input to terminal 120 may likewise correlate to a lower determined resistance between terminal 120 and wiper terminal 130.

A resistance between input terminal 120 and wiper terminal 130 may be modeled by the equation:

$$\frac{(2^n - \text{CODE2}) * R_{MAX}}{2^n}, \quad \text{(v)}$$

wherein CODE2 is the digital input code applied to terminal 120, and $R_{MAX}$ is the maximum resistance that may be achieved.

Equation (v) may be contrasted with equation (ii). Equation (v) clearly demonstrates a system in which the resistance of the lower branch may be independent of the resistance of the upper branch and the input code to the upper branch. Likewise, switches 150.1-150.N and 152.1-152.N in string arrays 140 and 142 may not be affected and may not turn on or off when CODE2 is applied to terminal 120. The resistance between terminal 120 and wiper terminal 130 may also be modeled by the equation $$\frac{\text{CODE2} * R_{MAX}}{2^n},$$

depending on the relationship between the input code and the turned on switch.

Several embodiments of the invention are specifically illustrated and/or described herein. However, it will be appreciated that modifications and variations of the invention are covered by the above teachings and within the purview of the appended claims without departing from the spirit and intended scope of the invention.

What is claimed is:

1. A digital potentiometer, comprising:

a wiper terminal;

a first terminal receiving a first digital input code, the first terminal being connected to the wiper terminal through at least one string array, wherein the first digital input code determines a resistance between the first terminal and the wiper terminal; and a second terminal receiving a second digital input code, the second terminal being connected to the wiper terminal through at least one additional string array, wherein the second digital input code determines a resistance between the second terminal and the wiper terminal;

wherein the resistance between the first terminal and the wiper terminal and the resistance between the second terminal and the wiper terminal are determined independently of each other.

2. The digital potentiometer according to claim 1, wherein the at least one string array has a plurality of switches connected to an array of resistors at selected tap points.

3. The digital potentiometer according to claim 2, wherein the at least one additional string array has a plurality of switches connected to an array of resistors at selected tap points.

4. The digital potentiometer according to claim 2, wherein the plurality of switches are connected in parallel.

5. The digital potentiometer according to claim 2, wherein the array of resistors are connected in series.

6. The digital potentiometer according to claim 2, wherein the plurality of switches are alternately closed to connect a segment of the array of resistors from a connected tap point to the wiper terminal.

7. The digital potentiometer according to claim 2, wherein the plurality of switches are alternately closed to connect the first terminal to the wiper terminal.

8. The digital potentiometer according to claim 3, wherein the plurality of switches are connected in parallel.

9. The digital potentiometer according to claim 3, wherein the array of resistors are connected in series.

10. The digital potentiometer according to claim 3, wherein the plurality of switches are alternately closed to connect a segment of the array of resistors from a connected tap point to the wiper terminal.

11. The digital potentiometer according to claim 3, wherein the plurality of switches are alternately closed to connect the second terminal to the wiper terminal.

12. A method for independently controlling a first resistance of a first arm and a second resistance of a second arm of a digital potentiometer, the method comprising:

receiving a first digital input code at a first terminal, the first digital input code turning on one of a plurality of switches in at least one string, a first resistance being set between the first terminal and a wiper terminal based on the turned on switches in the at least one string; and receiving a second digital input code at a second terminal, the second digital input code turning on one of a plurality of switches in at least one additional string, a second resistance being set between the second terminal and the wiper terminal based on the turned on switches in the at least one additional string;

wherein the first resistance between the first terminal and the wiper terminal and the second resistance between the second terminal and the wiper terminal are set independently of each other.

13. The method according to claim 12, further comprising: changing the first digital code to vary the first resistance.

14. The method according to claim 13, further comprising: changing the second digital code to vary the second resistance.

15. The method according to claim 13, further comprising: turning off the one of the plurality of switches in the at least one string.

16. The method according to claim 14, further comprising: turning off the one of the plurality of switches in the at least one additional string.

17. The method according to claim 15, further comprising: turning on another one of the plurality of switches in the at least one string.

18. The method according to claim 16, further comprising: turning on another one of the plurality of switches in the at least one additional string.

19. The method according to claim 12, wherein the at least one string is connected in series between the first terminal and the wiper terminal.

20. The method according to claim 19, wherein the at least one additional string is connected in series between the second terminal and the wiper terminal.

21. The digital potentiometer according to claim 2, wherein the array of resistors is connected to output terminals of the plurality of switches.

22. The method according to claim 12, wherein an array of resistors is connected to output terminals of the plurality of switches in the at least one string.

23. The method according to claim 12, wherein an array of resistors is connected to output terminals of the plurality of switches in the at least one additional string.

* * * * *